US010439285B2

(12) United States Patent
Isik et al.

(10) Patent No.: US 10,439,285 B2
(45) Date of Patent: Oct. 8, 2019

(54) CLOAKED LOW BAND ELEMENTS FOR MULTIBAND RADIATING ARRAYS

(71) Applicant: CommScope Technologies LLC, Hickory, NC (US)

(72) Inventors: Ozgur Isik, Gladesville (AU); Philip Raymond Gripo, Toongabbie (AU); Dushmantha Nuwan Prasanna Thalakotuna, Rosehill (AU); Peter J. Liversidge, Glenbrook (AU)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/517,906

(22) PCT Filed: Aug. 6, 2015

(86) PCT No.: PCT/US2015/044020
§ 371 (c)(1),
(2) Date: Apr. 7, 2017

(87) PCT Pub. No.: WO2016/081036
PCT Pub. Date: May 26, 2016

(65) Prior Publication Data

US 2017/0310009 A1 Oct. 26, 2017

Related U.S. Application Data

(60) Provisional application No. 62/081,358, filed on Nov. 18, 2014.

(51) Int. Cl.
*H01Q 21/12* (2006.01)
*H01Q 5/49* (2015.01)
(Continued)

(52) U.S. Cl.
CPC ..... *H01Q 5/49* (2015.01); *H01Q 1/24* (2013.01); *H01Q 1/523* (2013.01); *H01Q 9/16* (2013.01);
(Continued)

(58) Field of Classification Search
CPC .. H01Q 1/52; H01Q 1/24; H01Q 9/16; H01Q 19/10; H01Q 5/49; H01Q 21/06; H01Q 21/30; H01Q 25/00
(Continued)

(56) References Cited

U.S. PATENT DOCUMENTS 9,276,329 B2 3/2016 Jones et al.
2002/0140618 A1 10/2002 Plet et al.
(Continued)

FOREIGN PATENT DOCUMENTS

JP 2005 176120 A 6/2005
JP 2005176120 A 6/2005
WO WO 2014/100938 A1 7/2014

OTHER PUBLICATIONS

Notification Concerning Transmittal of International Preliminary Report on Patentability, International Application No. PCT/US2015/044020, dated Jun. 1, 2017, 8 pages.
(Continued)

*Primary Examiner* — Joseph J Lauture
(74) *Attorney, Agent, or Firm* — Myers Bigel, P.A.

(57) ABSTRACT

A multiband antenna, having a reflector, and a first array of first radiating elements having a first operational frequency band, the first radiating elements being a plurality of dipole arms, each dipole arm including a plurality of conductive segments coupled in series by a plurality of inductive elements; and a second array of second radiating elements having a second operational frequency band, wherein the plurality of conductive segments each have a length less
(Continued)

than one-half wavelength at the second operational frequency band.

37 Claims, 5 Drawing Sheets

(51) Int. Cl.

| | |
|---|---|
| ***H01Q 1/24*** | (2006.01) |
| ***H01Q 1/52*** | (2006.01) |
| ***H01Q 9/16*** | (2006.01) |
| ***H01Q 19/10*** | (2006.01) |
| ***H01Q 21/26*** | (2006.01) |
| ***H01Q 21/06*** | (2006.01) |
| *H01Q 25/00* | (2006.01) |
| *H01Q 21/30* | (2006.01) |

(52) U.S. Cl.
CPC ..... *H01Q 19/108* (2013.01); *H01Q 21/062* (2013.01); *H01Q 21/26* (2013.01); *H01Q 1/246* (2013.01); *H01Q 21/06* (2013.01); *H01Q 21/30* (2013.01); *H01Q 25/00* (2013.01); *H01Q 25/001* (2013.01)

(58) Field of Classification Search
USPC ..... 343/815, 722, 702, 810, 893, 876, 725
See application file for complete search history.

(56) References Cited

U.S. PATENT DOCUMENTS

| | | | | |
|---|---|---|---|---|
| 2003/0034917 | A1 | 2/2003 | Nishizawa et al. | |
| 2004/0066341 | A1 | 4/2004 | Ito et al. | |
| 2004/0183737 | A1 | 9/2004 | Lindenmeier | |
| 2012/0154236 | A1 | 6/2012 | Apostolos et al. | |
| 2015/0214617 | A1* | 7/2015 | Shang ..... | H01Q 1/246 343/722 |

OTHER PUBLICATIONS

International Search Report, International Application No. PCT/US2015/044020, dated Nov. 12, 2015.

Written Opinion of the International Searching Authority, International Application No. PCT/US2015/044020, dated Nov. 12, 2015.

Communication Pursuant to Article 94(3) EPC in corresponding European Patent Application No. 15 750 581.9-1205 (dated May 15, 2019).

Extended European Search Report for corresponding European Application No. 19151403.3, dated May 17, 2019.

* cited by examiner

CLOAKED LOW BAND ELEMENTS FOR MULTIBAND RADIATING ARRAYS

CROSS REFERENCE TO RELATED APPLICATIONS

This application is a 35 U.S.C. § 371 national stage application of PCT International Application No. PCT/US2015/044020, filed Aug. 6, 2015, which itself claims priority to U.S. Provisional Patent Application No. 62/081,358, filed Nov. 18, 2014, the disclosure and content of both of which are incorporated by reference herein in their entireties. The above-referenced PCT International Application was published in the English language as International Publication No. WO 2016/081036 A1 on May 26, 2016.

FIELD OF THE INVENTION

This invention relates to wide-band multi-band antennas with interspersed radiating elements intended for cellular base station use. In particular, the invention relates to radiating elements intended for a low frequency band when interspersed with radiating elements intended for a high frequency band. This invention is aimed at minimizing the effect of the low-band dipole arms, and/or parasitic elements if used, on the radio frequency radiation from the high-band elements.

BACKGROUND

Undesirable interactions may occur between radiating elements of different frequency bands in multi band interspersed antennas. For example, in some cellular antenna applications, the low band is 694-960 MHz and the high band is 1695-2690 MHz. Undesirable interaction between these bands may occur when a portion of the lower frequency band radiating structure resonates at the wavelength of the higher frequency band. For instance, in multiband antennas where a higher frequency band is a multiple of a frequency of a lower frequency band, there is a probability that the low band radiating element, or some component or part of it, will be resonant in some part of the high band frequency range. This type of interaction may cause a scattering of high band signals by the low band elements. As a result, perturbations in radiation patterns, variation in azimuth beam width, beam squint, high cross polar radiation and skirts in radiation patterns are observed in the high band.

SUMMARY

In one aspect of the present invention, a low band radiating element for use in a multiband antenna having at least a high band operational frequency and a low band operational frequency is provided. The low band element comprises a first dipole element having a first polarization and comprising a first pair of dipole arms and a second dipole element having a second polarization and comprising a second pair of dipole arms oriented at approximately 90 degrees to the first pair of dipole arms. Each dipole arm includes a plurality of conductive segments, each having a length less than one-half wavelength at the high band operational frequency, coupled in series by a plurality of inductive elements, having an impedance selected to attenuate high band currents while passing low band currents in the dipole arms. The inductive elements are selected to appear as high impedance elements at the high band operational frequency and as lower impedance elements at the low band operational frequency.

In another aspect of the present invention, a multiband antenna is provided. The multiband antenna includes a reflector, a first array of first radiating elements and a second array of second radiating elements. The first radiating elements have a first operational frequency band and the second radiating elements have a second operational frequency band. The first radiating elements include two or more dipole arms. Each dipole arm includes a plurality of conductive segments coupled in series by a plurality of inductive elements. The conductive segments each have a length less than one-half wavelength at the second operational frequency band. The first radiating elements may comprise single dipole elements or cross dipole elements.

The inductive elements are typically selected to appear as high impedance elements at the second operational frequency band and as lower impedance elements at the first operational frequency band. The first operational frequency band typically comprises a low band of the multiband antenna and the second operational frequency band typically comprises a high band of the multiband antenna.

In another aspect of the present invention, parasitic elements may be included on the multiband antenna to shape low band beam characteristics. For example, the parasitic elements may have an overall length selected to shape beam patterns in the first operational frequency band, and comprise conductive segments coupled in series with inductive elements selected to reduce interaction between the parasitic elements and radiation at the second operational frequency band. The conductive segments of the parasitic elements may also have a length of less than one half wave length at the second operational frequency band.

DESCRIPTION OF THE INVENTION

Figure 1:
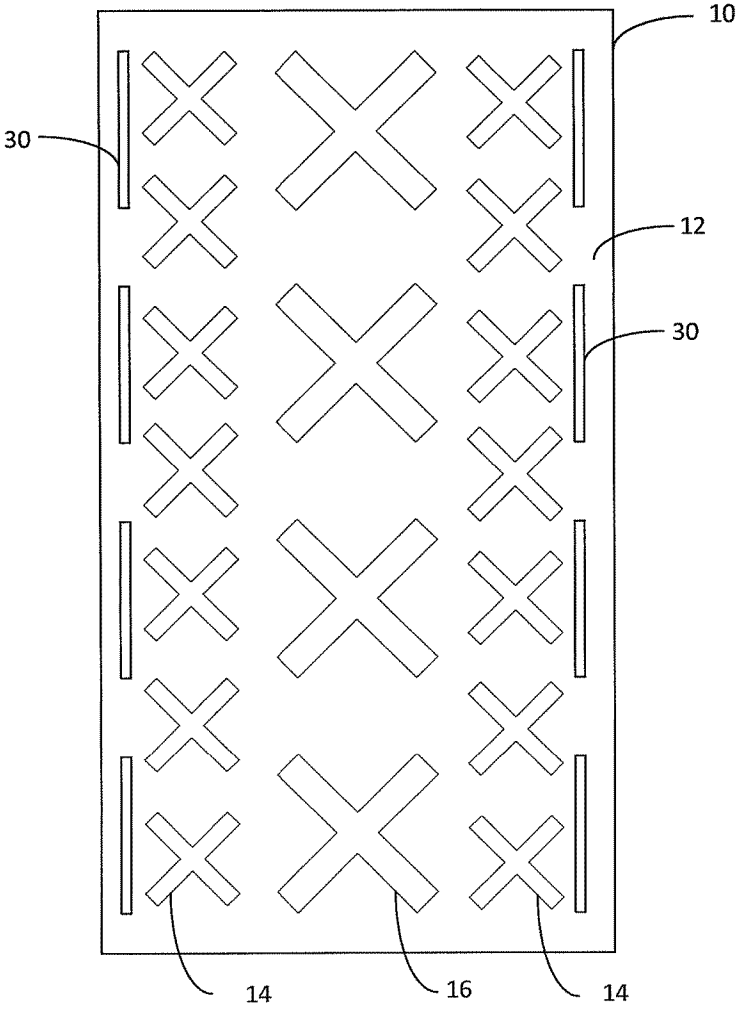
FIG. 1 is a schematic diagram of an antenna according to one aspect of the present invention.

FIG. 1 schematically diagrams a dual band antenna 10. The dual band antenna 10 includes a reflector 12, an array of high band radiating elements 14 and an array of low band radiating elements 16. Optionally, parasitic elements 30 may be included to shape azimuth beam width of the low band elements. Multiband radiating arrays of this type commonly include vertical columns of high band and low band elements spaced at pre-determined intervals. See, for example, U.S. patent application Ser. No. 13/827,190, now U.S. Pat. No. 9,276,329 to Jones et al., which is incorporated by reference.

Figure 2:
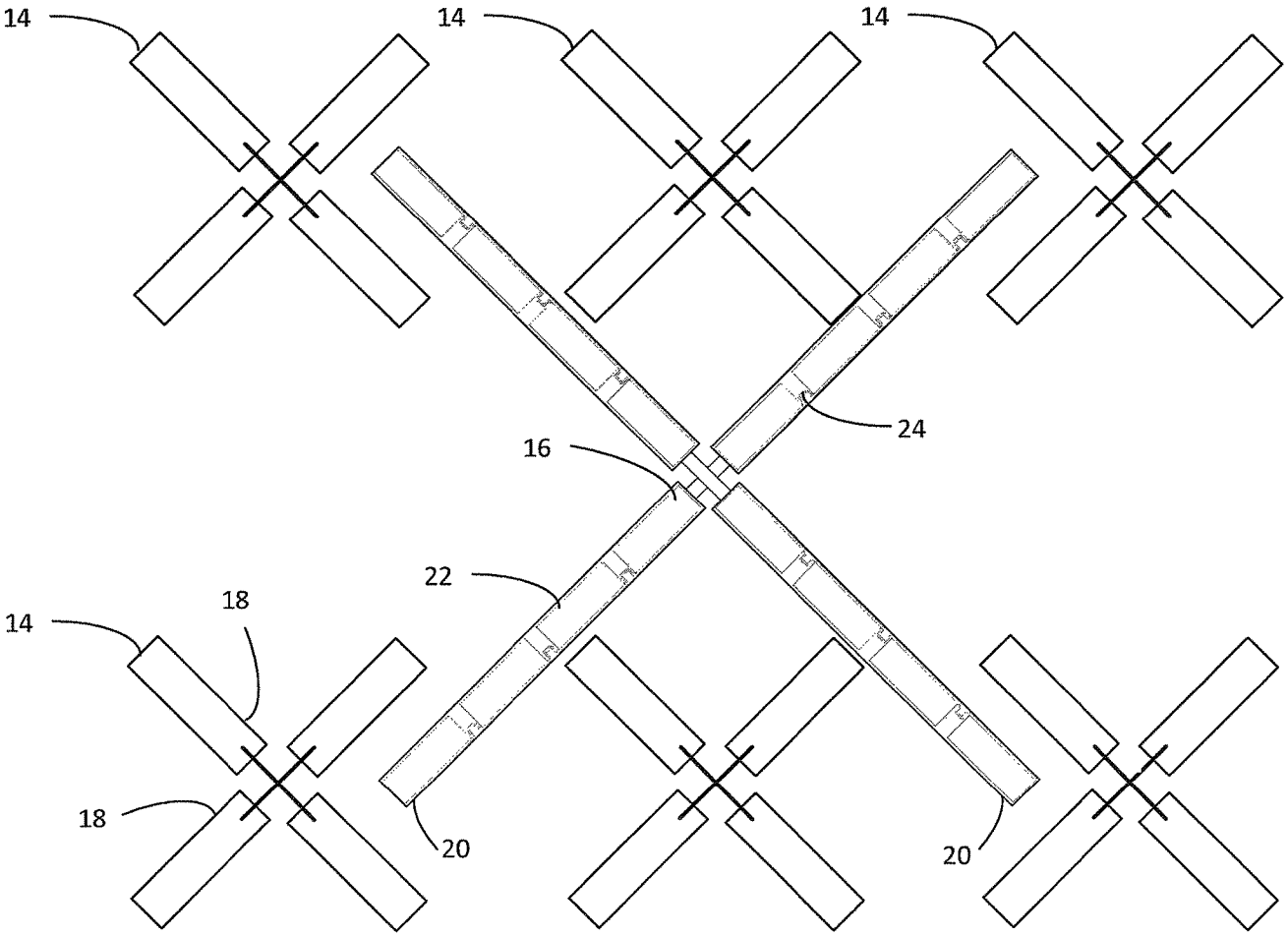
FIG. 2 is a plan view of a portion of an antenna array according to another aspect of the present invention.

FIG. 2 schematically illustrates a portion of a wide band dual band antenna 10 including features of a low band radiating element 16 according to one aspect of the present invention. High band radiating elements 14 may comprise any conventional crossed dipole element, and may include first and second dipole arms 18. Other known high band elements may be used. The low band radiating element 16 also comprises a crossed dipole element, and includes first and second dipole arms 20. In this example, each dipole arm 20 includes a plurality of conductive segments 22 coupled in series by inductors 24.

The low band radiating element 16 may be advantageously used in multi-band dual-polarization cellular base-station antenna. At least two bands comprise low and high bands suitable for cellular communications. As used herein, "low band" refers to a lower frequency band, such as 694-960 MHz, and "high band" refers to a higher frequency band, such as 1695 MHz-2690 MHz. The present invention is not limited to these particular bands, and may be used in other multi-band configurations. A "low band radiator" refers to a radiator for such a lower frequency band, and a "high band radiator" refers to a radiator for such a higher frequency band. A "dual band" antenna is a multi-band antenna that comprises the low and high bands referred to throughout this disclosure.

Figure 3:
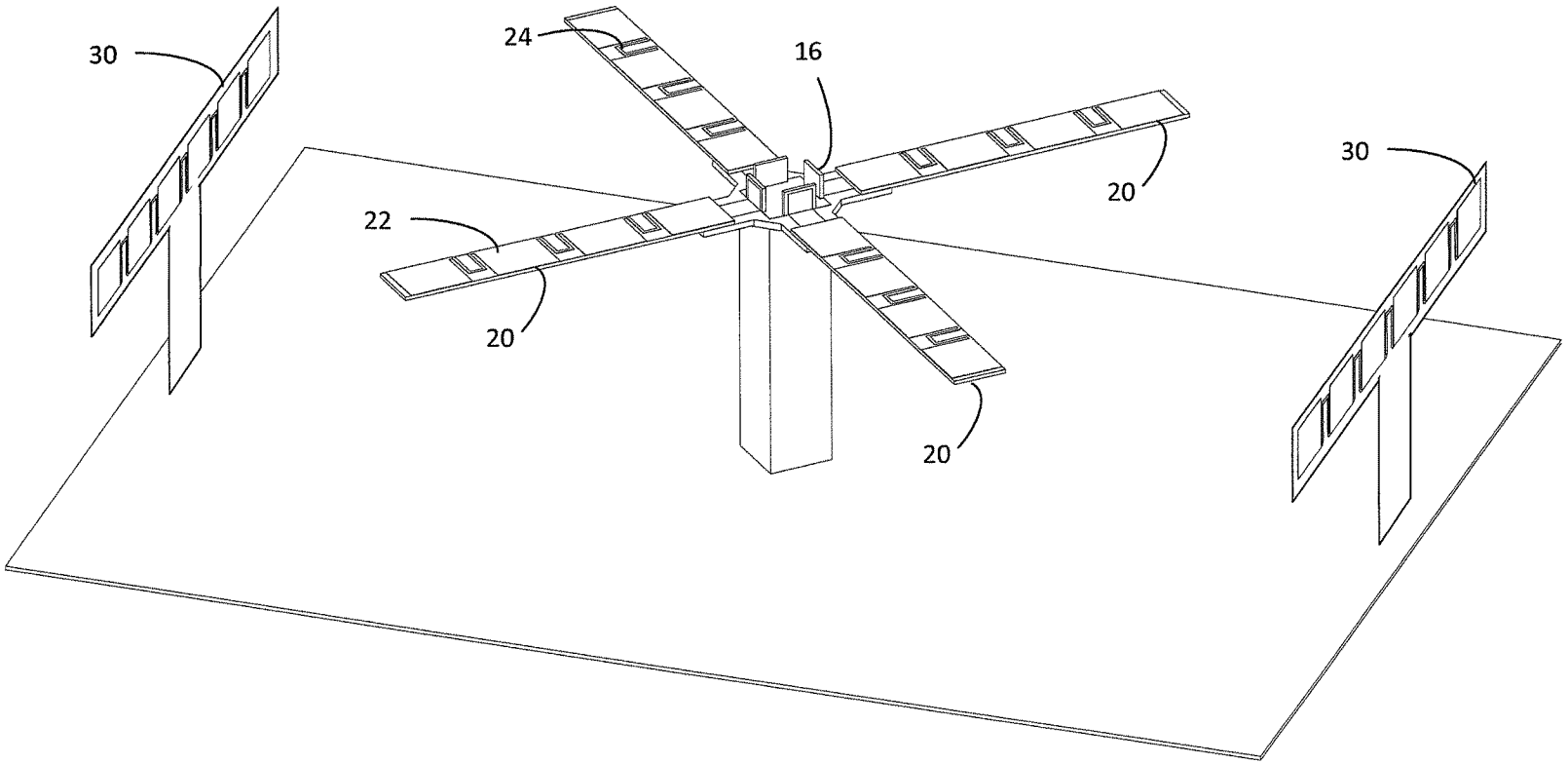
FIG. 3 is an isometric view of a low band radiating element and parasitic elements according to another aspect of the present invention.
Figure 4:
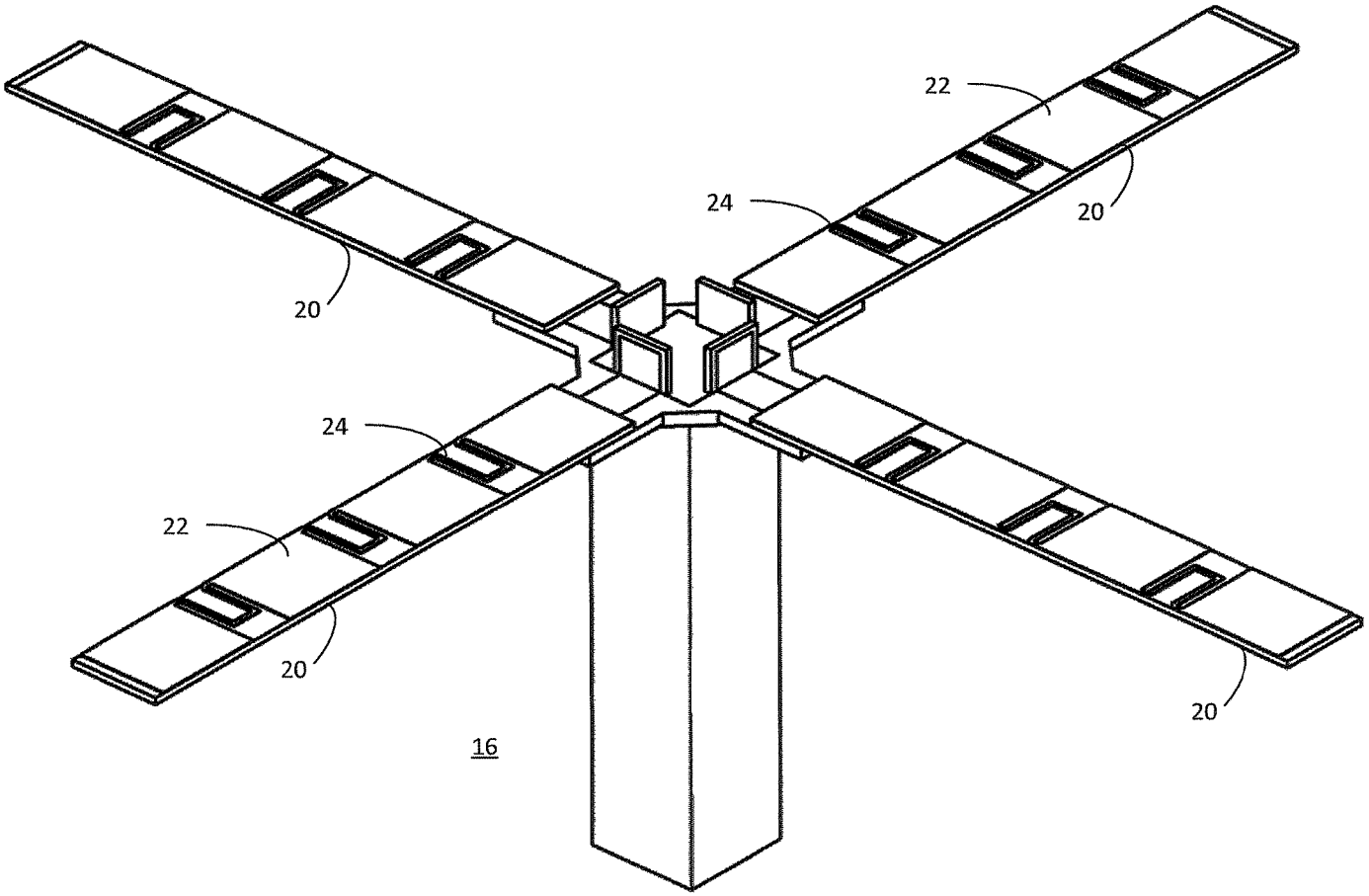
FIG. 4 is a more detailed view of the low band radiating element of FIG. 3.

Referring to FIG. 3, a low band radiating element 16 and a pair of parasitic elements 30 are illustrated mounted on reflector 12. In one aspect of the present invention, parasitic elements 30 are aligned to be approximately parallel to a longitudinal dimension of reflector 12 to help shape the beam width of the pattern. In another aspect of the invention, the parasitic elements may be aligned perpendicular to a longitudinal axis of the reflector 12 to help reduce coupling between the elements. The low band radiating element 16 is illustrated in more detail in FIG. 4. Low band radiating element 16 includes a plurality of dipole arms 20. The dipole arms 20 may be one half wave length long. The low band dipole arms 20 include a plurality of conductive segments 22. The conductive segments 22 have a length of less than one-half wavelength at the high band frequencies. For example, the wavelength of a radio wave at 2690 MHz is about 11 cm, and one-half wavelength at 2690 MHz would be about 5.6 cm. In the illustrated example, four segments 22 are included, which results in a segment length of less than 5 cm, which is shorter than one-half wavelength at the upper end of the high band frequency range. The conductive segments 22 are connected in series with inductors 24. The inductors 24 are configured to have relatively low impedance at low band frequencies and relatively higher impedance at high band frequencies.

In the examples of FIGS. 2 and 3, the dipole arms 20, including conductive segments 22 and inductors 24, may be fabricated as copper metallization on a non-conductive substrate using, for example, conventional printed circuit board fabrication techniques. In this example, the narrow metallization tracks connecting the conductive segments 22 comprise the inductors 24. In other aspect of the invention, the inductors 24 may be implemented as discrete components.

At low band frequencies, the impedance of the inductors 24 connecting the conductive segments 22 is sufficiently low to enable the low band currents continue to flow between conductive segments 22. At high band frequencies, however, the impedance is much higher due to the series inductors 24, which reduces high band frequency current flow between the conductive segments 22. Also, keeping each of the conductive segments 22 to less than one half wavelength at high band frequencies reduces undesired interaction between the conductive segments 22 and the high band radio frequency (RF) signals. Therefore, the low band radiating elements 16 of the present invention reduce and/or attenuate any induced current from high band RF radiation from high band radiating elements 14, and any undesirable scattering of the high band signals by the low band dipole arms 20 is minimized. The low band dipole is effectively electrically invisible, or "cloaked," at high band frequencies.

As illustrated in FIG. 3, the low band radiating elements 16 having cloaked dipole arms 20 may be used in combination with cloaked parasitic elements 30. However, either cloaked structure may also be used independently of the other. Referring to FIGS. 1 and 3, parasitic elements 30 may be located on either side of the driven low band radiating element 16 to control the azimuth beam width. To make the overall low band radiation pattern narrower, the current in the parasitic element 30 should be more or less in phase with the current in the driven low band radiating element 16. However, as with driven radiating elements, inadvertent resonance at high band frequencies by low band parasitic elements may distort high band radiation patterns.

Figure 5:
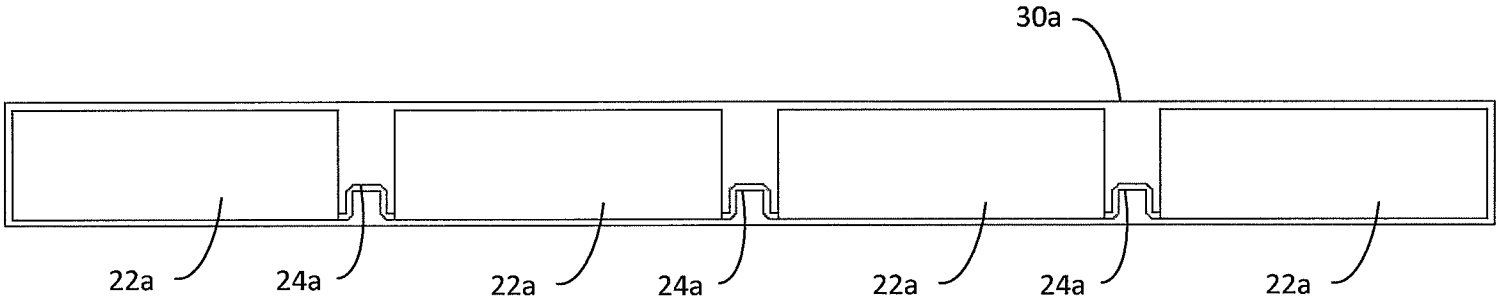
FIG. 5 is a first example of a parasitic element according to another aspect of the present invention.
Figure 6:
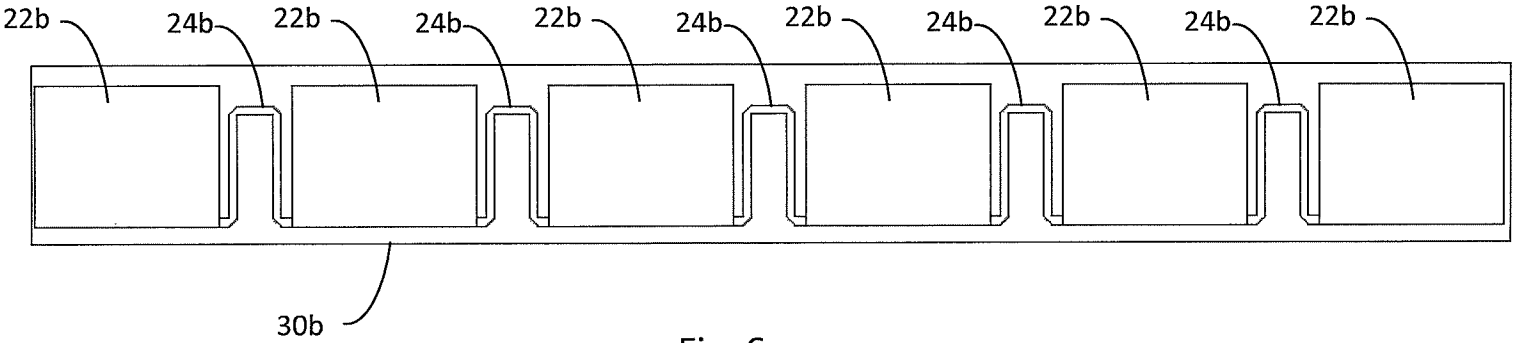
FIG. 6 is a second example of a parasitic element accordingly to another aspect of the present invention.

A first example of a cloaked low band parasitic element 30*a* is illustrated in FIG. 5. The segmentation of the parasitic elements may be accomplished in the same way as the segmentation of the dipole arms in FIG. 4. For example, parasitic element 30*a* includes four conductive segments 22*a* coupled by three inductors 24*a*. A second example of a cloaked low band parasitic element 30*b* is illustrated in FIG. 6. Parasitic element 30*b* includes six conductive segments 22*b* coupled by five inductors 24*b*. Relative to parasitic element 30*a*, the conductive segments 22*b* are shorter than the conductive segments 22*a*, and the inductor traces 24*b* are longer than the inductor traces 24*a*.

At high band frequencies, the inductors 24*a*, 24*b* appear to be high impedance elements which reduce current flow between the conductive segments 22*a*, 22*b*, respectively. Therefore the effect of the low band parasitic elements 30 scattering of the high band signals is minimized. However, at low band, the distributed inductive loading along the parasitic element 30 tunes the phase of the low band current, thereby giving some control over the low band azimuth beam width.

In a multiband antenna according to one aspect of the present invention described above, the dipole radiating element 16 and parasitic elements 30 are configured for low band operation. However, the invention is not limited to low band operation, the invention is contemplated to be employed in additional embodiments where driven and/or passive elements are intended to operate at one frequency band, and be unaffected by RF radiation from active radiating elements in other frequency bands. The exemplary low band radiating element 16 also comprises a cross-dipole radiating element. Other aspects of the invention may utilize a single dipole radiating element if only one polarization is required.

What is claimed is:

1. A multiband antenna, comprising:

a reflector;

a first array of first radiating elements having a first operational frequency band, the first radiating elements comprising a plurality of dipole arms, each dipole arm including a plurality of conductive segments coupled in series by a plurality of inductive elements comprising planar inductive traces; and a second array of second radiating elements having a second operational frequency band;

wherein the plurality of conductive segments each have a length less than one-half wavelength at the second operational frequency band.

2. The multiband antenna of claim 1, wherein the inductive elements are configured to have a high impedance that attenuates currents in the dipole arms in the second operational frequency band and have a low impedance that passes currents in the dipole arms in at the first operational frequency band.

3. The multiband antenna of claim 1, wherein the first operational frequency band comprises a low band of the multiband antenna and the second operational frequency band comprises a high band of the multiband antenna.

4. The multiband antenna of claim 3, further comprising a parasitic element mounted adjacent a first of the first radiating elements, the parasitic element comprising a plurality of conductive elements coupled in series by a plurality of inductive elements, wherein the inductive elements of the parasitic element are distributed along the parasitic element to tune a phase of a low band current in the parasitic element.

5. The multiband antenna of claim 1, further comprising a plurality of parasitic elements that are adjacent sides of the reflector, wherein the parasitic elements comprise conductive segments coupled in series with inductive elements selected to reduce interaction between the parasitic elements and radiation at the second operational frequency band.

6. The multiband antenna of claim 1, wherein the first and second operational frequency bands comprise first and second cellular frequency bands, respectively, wherein the first radiating elements comprise a plurality of crossed dipole elements, respectively, and wherein each dipole arm includes three inductive elements.

7. A multiband cellular base station antenna, comprising:

a reflector;

a first array of first radiating elements that are configured for operation in a first operational frequency band of the multiband cellular base station antenna, the first radiating elements comprising a plurality of dipole arms, each dipole arm including a plurality of conductive segments that are formed on a planar, non-conductive substrate, the conductive segments coupled in series by a plurality of inductive elements that comprise narrow metallization tracks formed on the planar, non-conductive substrate; and a second array of second radiating elements that are configured for operation in a second operational frequency band of the multiband cellular base station antenna;

wherein each of the plurality of conductive segments has a length that is less than one-half of a wavelength at the second operational frequency band.

8. The multiband cellular base station antenna of claim 7, further comprising a plurality of parasitic elements, wherein the parasitic elements comprise alternating conductive segments and inductive elements that are coupled together in series.

9. The multiband cellular base station antenna of claim 8, wherein each of the conductive segments of at least one of the parasitic elements has a length less than one half wavelength at the second operational frequency band.

10. The multiband cellular base station antenna of claim 7, further comprising a plurality of parasitic elements, wherein at least some of the parasitic elements are positioned adjacent the second array of second radiating elements.

11. The multiband cellular base station antenna of claim 7, further comprising a plurality of parasitic elements that are adjacent sides of the reflector, wherein the parasitic elements each have an overall length and position that is selected to reduce coupling between opposite polarization dipole elements in the first operational frequency band.

12. The multiband cellular base station antenna of claim 7, further comprising a plurality of parasitic elements, wherein a first of the first radiating elements is positioned between first and second of the parasitic elements.

13. The multiband cellular base station antenna of claim 12, wherein the first parasitic element is on a first side of the reflector and is aligned to be approximately parallel to a longitudinal dimension of the reflector and the second parasitic element is on a second side of the reflector and aligned to be approximately parallel to the longitudinal dimension of the reflector, and the first of the first radiating elements is positioned along a transverse axis connecting the first and second parasitic elements.

14. The multiband cellular base station antenna of claim 13, wherein the first and second parasitic elements each comprise alternating conductive segments and inductive elements that are coupled together in series.

15. The multiband cellular base station antenna of claim 12, wherein the first and second parasitic elements are aligned to be perpendicular to a longitudinal dimension of the reflector.

16. The multiband cellular base station antenna of claim 7, wherein the first operational frequency band comprises a cellular low band of the multiband cellular base station antenna and the second operational frequency band comprises a cellular high band of the multiband cellular base station antenna, wherein the inductive elements are fewer in number than the conductive segments on at least some of the dipole arms, wherein at least one of the inductive elements on each dipole arm comprises a copper metallization track that connects two adjacent ones of the conductive segments, wherein a length of the copper metallization track exceeds a length of a gap between the two adjacent ones of the conductive segments.

17. The multiband cellular base station antenna of claim 7, wherein at least one of the inductive elements on each dipole arm comprises a copper metallization track that connects two adjacent ones of the conductive segments, wherein a length of the copper metallization track exceeds a length of a gap between the two adjacent ones of the conductive segments.

18. The multiband cellular base station antenna of claim 7, further comprising a parasitic element mounted adjacent a first of the first radiating elements, wherein the first operational frequency band comprises a cellular low band of the multiband cellular base station antenna and the second operational frequency band comprises a cellular high band of the multiband cellular base station antenna, wherein the parasitic element comprises a plurality of conductive segments coupled in series by a plurality of inductive elements, wherein each of the plurality of conductive segments of the parasitic element has a length that is less than one-half of a wavelength at the second operational frequency band, wherein the conductive segments and inductive elements of the parasitic element comprise copper metallization on a non-conductive substrate.

19. The multiband cellular base station antenna of claim 7, wherein at least two of the inductive elements comprise respective U-shaped metallization tracks.

20. The multiband cellular base station antenna of claim 7, wherein a first of the inductive elements on a first of the dipole arms is between first and second of the conductive segments, and the first of the inductive elements comprises a copper metallization track that has sections that extend in multiple directions, wherein a combined length of the sections exceeds respective widths of the first and second conductive segments in a transverse direction that is perpendicular to a longitudinal direction of the first of the dipole arms.

21. The multiband cellular base station antenna of claim 7, wherein a first of the conductive segments on a first of the dipole arms has a first length in a longitudinal direction of the first of the dipole arms, the first length exceeding a length of a gap between the first of the conductive segments and a second of the conductive segments on the first of the dipole arms that is adjacent the first of the conductive segments.

22. The multiband cellular base station antenna of claim 7, further comprising a parasitic element mounted adjacent a first of the first radiating elements, wherein the parasitic element is configured so that current in the parasitic element is substantially in phase with current in the first of the first radiating elements.

23. The multiband cellular base station antenna of claim 7, wherein the first radiating elements comprise a plurality of crossed dipole elements, respectively.

24. The multiband cellular base station antenna of claim 7, wherein each dipole arm includes three inductive elements.

25. The multiband cellular base station antenna of claim 24, wherein a first of the three inductive elements couples a first and a second of the plurality of conductive segments in series, wherein a second of the three inductive elements couples a third and the second of the plurality of conductive segments in series, and wherein a third of the three inductive elements couples a fourth and the third of the plurality of conductive segments in series.

26. The multiband cellular base station antenna of claim 7, wherein the length of each of the plurality of conductive segments is less than 5 cm.

27. A multiband antenna comprising:

a reflector;

a plurality of first radiating elements that are configured to operate in a first frequency band and that extend forwardly from the reflector;

a plurality of second radiating elements that are configured to operate in a second frequency band that is higher than the first frequency band, the second radiating elements extending forwardly from the reflector; and a plurality of parasitic elements that extend forwardly from the reflector, wherein a first of the plurality of parasitic elements comprises a plurality of conductive segments coupled in series by a plurality of inductors.

28. The multiband antenna of claim 27, wherein each of the plurality of parasitic elements comprises a plurality of conductive segments coupled in series by a plurality of inductors.

29. The multiband antenna of claim 28, wherein the plurality of parasitic elements comprises a first set of parasitic elements that extend approximately parallel to a longitudinal dimension of the reflector and a second set of parasitic elements that are aligned to be perpendicular to the longitudinal dimension of the reflector.

30. The multiband antenna of claim 27, further comprising a plurality of conductive segments coupled in series by a plurality of inductors on a first of the plurality of first radiating elements.

31. The multiband antenna of claim 27, wherein the plurality of first radiating elements comprises a plurality of crossed dipole elements, respectively, and wherein the first and second frequency bands comprise first and second cellular frequency bands, respectively.

32. The multiband antenna of claim 31, wherein a first of the plurality of crossed dipole elements is between a first pair of the plurality of parasitic elements, wherein a second of the plurality of crossed dipole elements is between a second pair of the plurality of parasitic elements, and wherein a first parasitic element of the first pair of the plurality of parasitic elements is aligned with a first parasitic element of the second pair of the plurality of parasitic elements along a longitudinal dimension of the reflector, and a second parasitic element of the first pair of the plurality of parasitic elements is aligned with a second parasitic element of the second pair of the plurality of parasitic elements along the longitudinal dimension of the reflector.

33. The multiband antenna of claim 27, wherein the plurality of parasitic elements comprises a first column of parasitic elements extending longitudinally along a first side of the reflector and a second column of parasitic elements extending longitudinally along a second side of the reflector, and wherein the plurality of first radiating elements and the plurality of second radiating elements are between the first and second columns of parasitic elements.

34. The multiband antenna of claim 33, wherein the plurality of first radiating elements comprises a vertical column of low band radiating elements at a center of the reflector, wherein the plurality of second radiating elements comprises a plurality of vertical columns of high band radiating elements, and wherein the first and second columns of parasitic elements are adjacent first and second edges, respectively, of the reflector.

35. The multiband antenna of claim 27, wherein at least some of the inductors comprise U-shaped metallization tracks.

36. The multiband antenna of claim 27, wherein the first of the plurality of parasitic elements is configured so that current in the first of the plurality of parasitic elements is substantially in phase with current in a first of the first radiating elements.

37. The multiband antenna of claim 27, wherein the plurality of first radiating elements comprises a column of low band crossed dipole radiating elements that extend along a longitudinal dimension of the reflector, wherein the plurality of second radiating elements comprises a plurality of columns of high band radiating elements that each extend along the longitudinal dimension of the reflector, wherein the first of the plurality of parasitic elements is adjacent a side edge of the reflector, wherein the plurality of conductive segments comprises a first plurality of conductive segments the multiband antenna further comprising a plurality of conductive segments coupled in series by a plurality of inductors on a first of the plurality of first radiating elements, and wherein the first and second pluralities of conductive segments comprise conductive segments that each have a length that is less than one-half of a wavelength at the second frequency band.

* * * * *